US006450814B1

(12) United States Patent
Brittain

(10) Patent No.: US 6,450,814 B1
(45) Date of Patent: Sep. 17, 2002

(54) NOVELTY TEETH ASSEMBLY

(75) Inventor: Patrick Brittain, Las Vegas, NV (US)

(73) Assignee: Billy-Bob Teeth, Inc., Michael, IL (US)

( * ) Notice: Subject to any disclaimer, the term of this patent is extended or adjusted under 35 U.S.C. 154(b) by 0 days.

(21) Appl. No.: 09/793,010

(22) Filed: Feb. 26, 2001

(51) Int. Cl.[7] ..... A61C 5/00
(52) U.S. Cl. ..... 433/215; 446/27
(58) Field of Search ..... 433/215, 202.1, 433/6; 472/70; 446/27, 395

(56) References Cited

U.S. PATENT DOCUMENTS

| | | | | | |
|---|---|---|---|---|---|
| 477,167 | A | | 6/1892 | Carter | |
| 3,826,003 | A | * | 7/1974 | Thenot | 433/202.1 |
| 3,883,982 | A | | 5/1975 | McClary | |
| 4,676,500 | A | | 6/1987 | Fricano | 272/8 |
| 4,863,411 | A | | 9/1989 | Brown | 446/27 |
| 4,920,580 | A | | 5/1990 | Liff | 2/206 |
| 5,083,770 | A | | 1/1992 | Holland | 272/8 |
| 5,239,841 | A | * | 8/1993 | Zwart | 63/2 |
| 5,951,291 | A | * | 9/1999 | Albert et al. | 433/215 |
| 5,983,670 | A | * | 11/1999 | Noda | 63/26 |

FOREIGN PATENT DOCUMENTS

DE 1297011 11/1969

OTHER PUBLICATIONS

"Dick Smith's Do–It–Yourself Monster Make–up," Morris Charlotte, Los Angeles, pp. 18, 28, 29, 33, 34, 43–44, 69–70 (Date Unknown–Admitted Prior Art).
"Special Make–Up Effects," by Vincent J–R Kehoe, Focal Press, pp. 113–122 (Date Unknown–Admitted Prior Art).
"Grande Illusions," a learn–by–example guide to The Art and Technique of Special Make–Up Effects from the films of Tom Savini, Morris, pp. 22–27 (Date Unknown–Admitted Prior Art).
Billy–Bob Teeth Brochure, 2 pages (Date Unknown–Admitted Prior Art).

* cited by examiner

*Primary Examiner*—John J. Wilson
*Assistant Examiner*—Melba Bumgarner
(74) *Attorney, Agent, or Firm*—Senniger, Powers, Leavitt & Roedel

(57) ABSTRACT

A novelty teeth assembly includes a retainer sized for fitting over at least a portion of a wearer's dentition and an artificial tooth secured to the retainer and extending outward therefrom. The artificial tooth has an opening therein adapted to receive and mount an ornamental member.

10 Claims, 3 Drawing Sheets

NOVELTY TEETH ASSEMBLY

BACKGROUND OF THE INVENTION

This invention relates to costume or theatrical ware, and more particularly to novelty teeth for costume or theatrical wear.

Novelty teeth are typically worn over a wearer's natural dentition for costume or theatrical purposes. One conventional type of novelty teeth comprises a retainer sized to fit over all or portion of the wearer's teeth and gums and one or more artificial teeth secured to and extending outward from the retainer. The teeth may be shaped, such as to simulate fangs or disfigurements, and the fronts of the retainer and teeth may also be arranged and treated to simulate other features such as gaps, missing teeth, overbite, decayed or stained teeth, gum abscesses and/or artificial crowns.

SUMMARY OF THE INVENTION

Among the several objects and features of the present invention is the provision of a novelty teeth assembly having an opening extending through at least one artificial tooth; the provision of such a novelty teeth assembly having an ornamental member supported by at least one artificial tooth of the assembly; and the provision of such a novelty teeth assembly which is easy to use.

In general, a novelty teeth assembly of the present invention comprises a retainer sized for fitting over at least a portion of a wearer's dentition and an artificial tooth secured to the retainer and extending outward therefrom. The artificial tooth has an opening therein adapted to receive and mount an ornamental member.

In another embodiment, the novelty teeth assembly further comprises an ornamental member supported by the artificial tooth in the opening.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
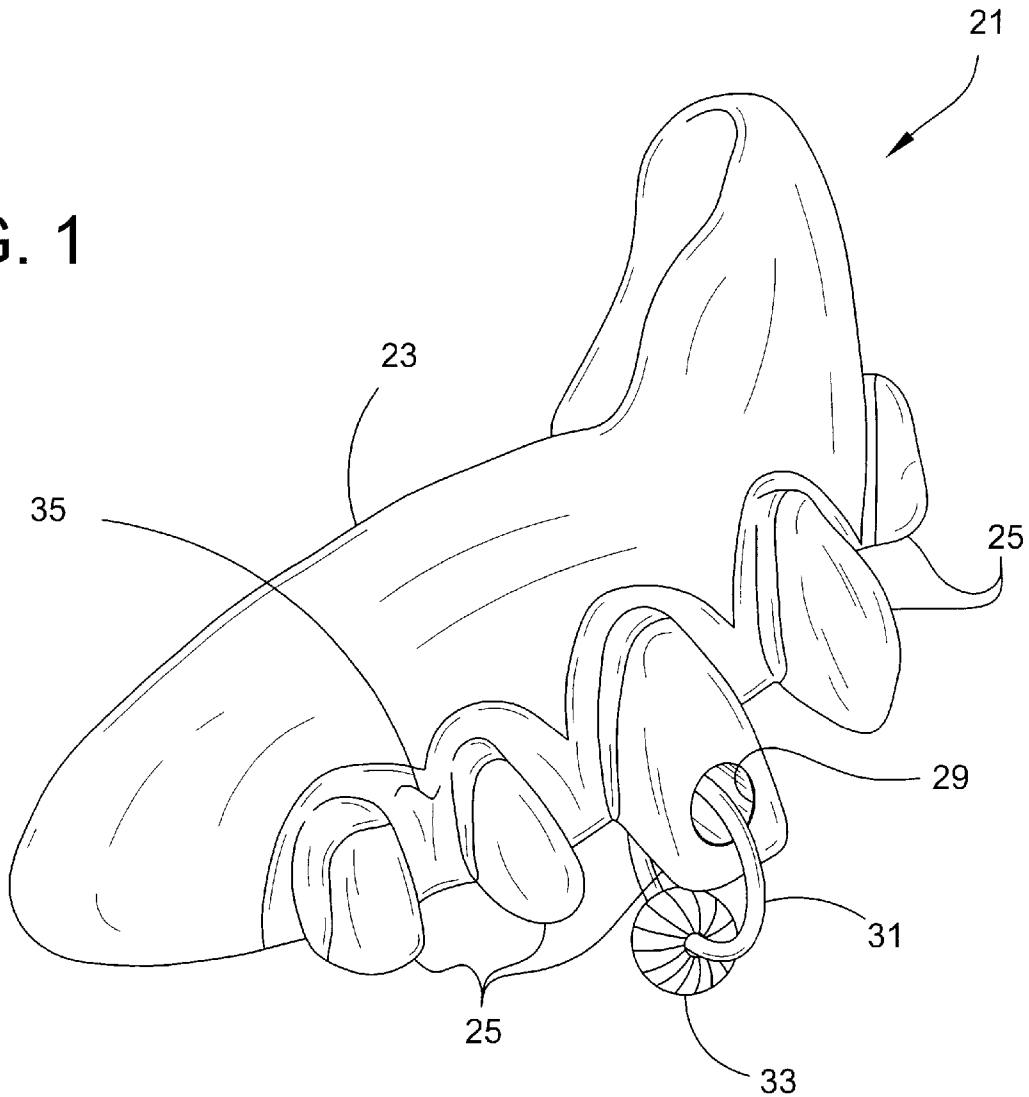
FIG. 1 is a perspective of a novelty teeth assembly of the present invention.
Figure 2:
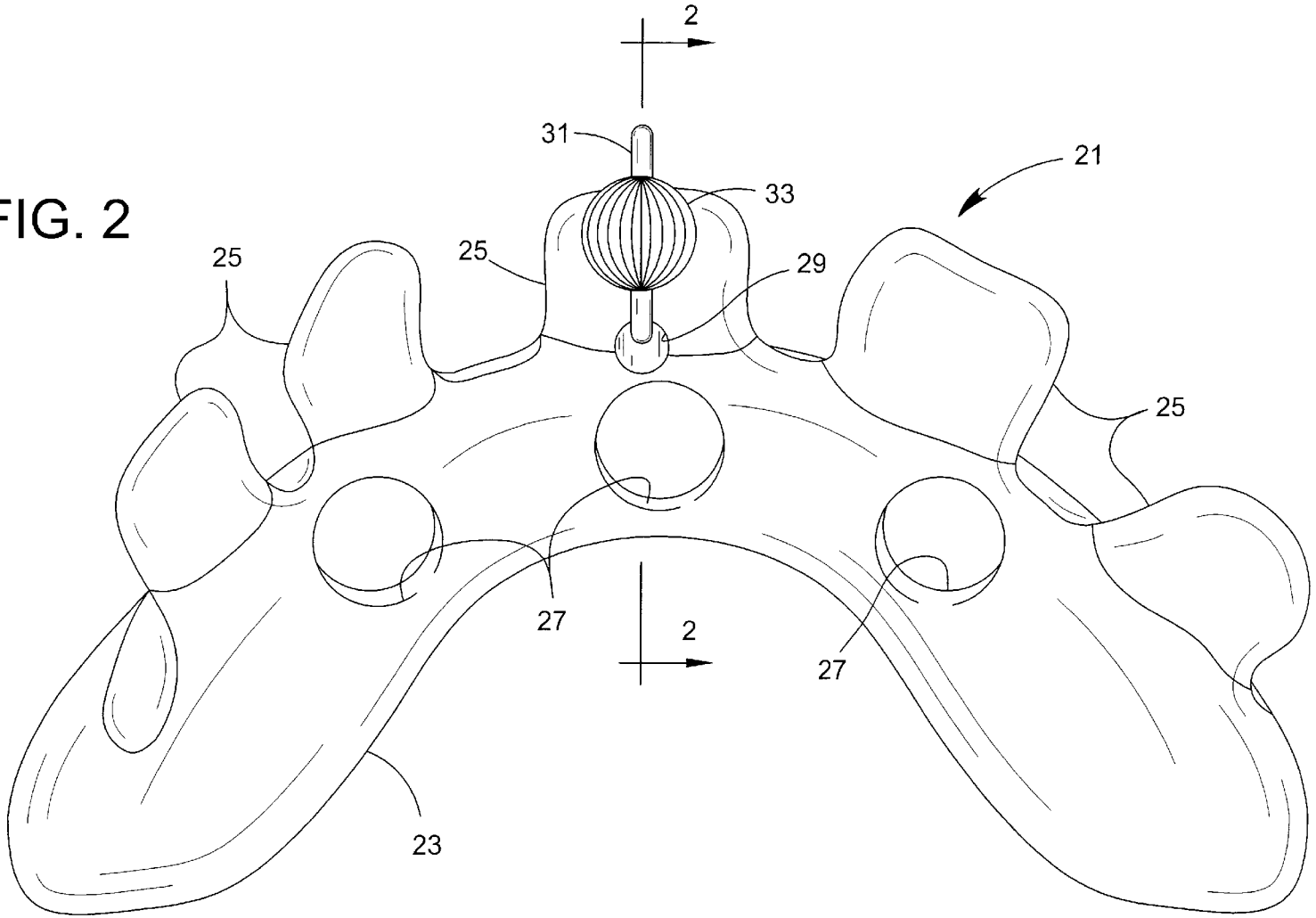
FIG. 2 is a bottom plan view of the novelty teeth assembly of FIG. 1.
Figure 3:
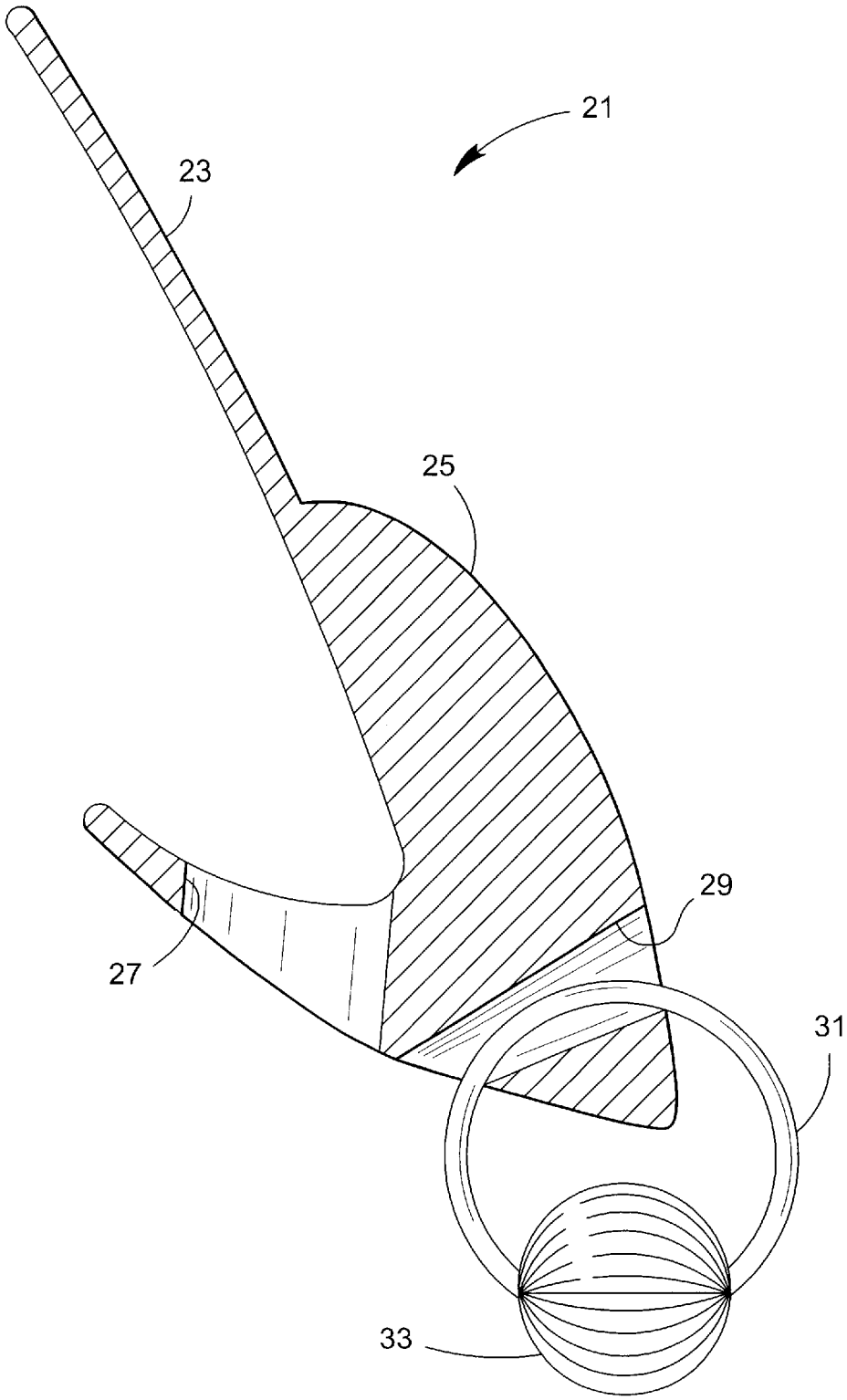
FIG. 3 is a section taken in the plane of line 3—3 of FIG. 1.

With reference to the drawings, and in particular to FIG. 1, a novelty teeth assembly of the present invention is generally indicated at 21. The novelty teeth assembly comprises a retainer 23 for seating over the wearer's natural dentition (e.g., teeth and gums) and an arrangement of artificial teeth 25 secured to and extending outward from the retainer. As shown in FIG. 3, the retainer 23 is generally J-shaped in cross-section. The retainer 23 of the illustrated embodiment is sized for fitting over the front and back of the wearer's teeth and gums and is configured for fitting over either the top or the bottom dentition of the wearer. The retainer 23 is constructed of conventional dental acrylic comprising acrylic powder and methylmetoacrylate monomer and is preferably pink in color to simulate natural gums.

The retainer 23 may be wearer. Holes 27 are disposed in the bottom or back of the retainer 23 for purposes which will become apparent.

The artificial teeth 25 are also constructed of acrylic and are preferably integrally formed with the retainer 23, such as by being molded integrally therewith. The teeth 25 may vary in size, number, shape and appearance to simulate a variety of dental conditions, such as gaps, missing teeth, overbite, decayed or stained teeth, gum abscesses and artificial crowns, without departing from the scope of this invention. As an example, the novelty teeth assembly 21 shown in FIG. 1 has artificial stain 35 on the front of the retainer surrounding the artificial teeth 25. With particular reference to FIG. 3, one artificial tooth 25 has an opening 29 extending generally laterally therethrough from the front to the back of the tooth. The opening 29 of the illustrated embodiment was formed by drilling a hole through the tooth 25 after molding of the retainer 23 and teeth 25. However, it is understood that the opening 29 may alternatively be formed during molding of the retainer 23 and teeth 25, such as by forming the mold to have the opening incorporated in the artificial tooth. The inner surface of the opening 29 may be stained (not shown) so as to make the opening more visible and pronounced. The opening 29 may alternatively extend laterally through the tooth 25 from one side to the other, or may extend angularly through the tooth. It is also contemplated that the opening 29 may extend only partially through the tooth 25 without departing from the scope of this invention.

A decorative ring 31, broadly defining an ornamental member, extends through the opening 29 of the tooth 25 and is supported by the tooth in the opening to depend from the tooth when the novelty teeth assembly 21 is in use. In the illustrated embodiment, a decorative bead 33 is mounted on the ring 31. It is contemplated that ornamental members having a configuration other than that of a ring may be used, such as hook-shaped or straight post earring-like members (not shown) that extend through the opening 29 and rest on the artificial tooth 25 and may be secured in the opening by a locking member (not shown) in the same manner as an earring.

The novelty teeth assembly 21 further comprises a putty mixture (not shown) for customizing the assembly to fit over a particular wearer's dentition. The putty mixture includes an acrylic polymer putty and catalyst putty such that, when the putties are mixed together, the putty mixture solidifies into a pliable or rubbery but solid mass. The acrylic polymer putty is preferably a polyvinylsiloxone with a base component. To customize the novelty teeth assembly 21, the putties are thoroughly mixed to form the putty mixture and then the mixture is placed into the retainer 23 so that some of the putty is worked into the holes 27 of the retainer. The retainer 23 is fitted over the wearer's teeth and gums, with the putty mixture surrounding the wearer's teeth. The wearer bites down on the assembly 21 or holds the assembly in place until the putty mixture sets and then removes the assembly from the mouth. The putty mixture then further hardens to a pliable, rubber-like consistency and is molded to the impression of the wearer's dentition. Excess putty mixture may be trimmed from the assembly 21.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including"

and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A novelty teeth assembly comprising:

a retainer sized for fitting over at least a portion of a wearer's dentition; and an artificial tooth secured to the retainer and extending outward therefrom, said artificial tooth having an opening therein adapted to receive and mount an ornamental member, said artificial tooth being stained generally within the opening.

2. A novelty teeth assembly comprising:

a retainer sized for fitting over at least a portion of a wearer's dentition;

an artificial tooth secured to the retainer and extending outward therefrom, said artificial tooth having an opening therein; and an ornamental member received and mounted in the opening of said artificial tooth, said ornamental member comprising a ring sized for insertion through the opening whereby a portion of the ring engages the tooth in the opening such that the artificial tooth supports the ring in the assembly.

3. A novelty teeth assembly as set forth in claim 2 wherein the opening extends fully through the artificial tooth.

4. A novelty teeth assembly as set forth in claim 3 wherein the opening extends through the artificial tooth generally from the front to the back thereof.

5. A novelty teeth assembly as set forth in claim 2 further comprising a decorative bead mounted on the ring.

6. A novelty teeth assembly comprising:

a retainer sized for fitting over at least a portion of a wearer's dentition;

an artificial tooth secured to the retainer and extending outward therefrom; and an ornamental member supported by the artificial tooth and depending therefrom.

7. A novelty teeth assembly as set forth in claim 6 wherein the ornamental member comprises a ring.

8. A novelty teeth assembly as set forth in claim 7 wherein the ornamental member further comprises a decorative bead mounted on the ring.

9. A novelty teeth assembly as set forth in claim 6 wherein the artificial tooth has an opening therein, the ornamental member being supported by the artificial tooth within said opening.

10. A novelty teeth assembly comprising:

a retainer sized for fitting over at least a portion of a wearer's dentition;

an artificial tooth secured to the retainer and extending outward therefrom, said artificial tooth having an opening extending fully therethrough; and an ornamental member supported by the artificial tooth and extending fully through the opening to extend outward from said tooth.

* * * * *